United States Patent [19]

Schow

[11] 4,055,064

[45] Oct. 25, 1977

[54] MUFFLER AND TAIL PIPE EXPANDER AND CLEANER

[76] Inventor: Virgle L. Schow, Box 7, Fairview, Mont. 59221

[21] Appl. No.: 647,637

[22] Filed: Jan. 8, 1976

[51] Int. Cl.[2] ..... B21D 41/02

[52] U.S. Cl. ..... 72/118; 72/123

[58] Field of Search ..... 72/118, 122, 123, 393; 15/104.02, 104.08, 104.09, 104.13; 29/523

[56] References Cited

U.S. PATENT DOCUMENTS

| | | | |
|---|---|---|---|
| 268,918 | 12/1882 | McIntyre | 72/122 |
| 319,559 | 6/1885 | Cashin | 72/122 |
| 784,129 | 3/1905 | Weinland | 15/104.13 |
| 915,584 | 3/1909 | Frazee | 15/104.08 |
| 1,097,673 | 5/1914 | Restucci | 15/104.13 |
| 1,809,258 | 6/1931 | Vertson | 15/104.02 |
| 3,343,390 | 9/1967 | Harris | 72/122 |
| 3,587,272 | 6/1971 | Zmuda | 72/122 |

*Primary Examiner*—Lowell A. Larson
*Attorney, Agent, or Firm*—Clarence A. O'Brien; Harvey B. Jacobson

[57] ABSTRACT

A muffler and tail pipe expander and cleaner has two wedges for spreading a split frame, and with two spiral serrated rollers mounted on each frame. After insertion of the tool in a pipe to be cleaned and expanded, a draw bolt is used to bring the wedges together, to in turn expand the two frame members and upon further turning of the tool, the helical angles of the serrated rollers will cause the tool to screw itself into the pipe and simultaneously remove rust and dents and increase the pipe to its original size.

7 Claims, 4 Drawing Figures

MUFFLER AND TAIL PIPE EXPANDER AND CLEANER

BACKGROUND OF THE INVENTION

1. Field of the Invention

This invention relates generally to tools for expanding tail pipes and mufflers and simultaneously cleaning same.

2. Description of the Prior Art

Known prior art devices of this type unduly complex for the nature of the tool. Many of them have numerous parts which can bind and fail to operate as designed. Furthermore, the more parts a tool has the greater the risk of losing one or more of these parts which in most cases renders the tool useless. Also, usually the more parts involved the greater the cost of the tool.

Also, with many prior art devices the metal working and cleaning elements are not readily replaceable once they become dull and deformed from use. Thus the entire tool is rendered useless because the primary working components are not replaceable.

Known prior art devices which may be pertinent to this invention are as follows:

| | | |
|---|---|---|
| 301,130 | F.L. Kollberg | July 1, 1884 |
| 410,282 | J. & P. Jardine | Sept. 3 1889 |
| 1,144,759 | A.C. Eek | June 29, 1915 |
| 3,077,916 | H.E. Vaughn | Feb. 19, 1963 |
| 3,587,272 | D.A. Zmuda | June 28, 1971 |

SUMMARY OF THE INVENTION

An object of the present invention is to provide a tool of simple construction for the expansion of mufflers and tail pipes together with the removal of rust and exhaust products therefrom.

Another object of the present invention is to provide a tail pipe expanding tool and cleaner and cleaner which has few component parts and having serrated rollers which are readily replaceable when they become worn and dull.

A further object of the present invention is to provide an expanding and cleaning tool which is extremely simple to operate by the ordinary unskilled person and is basically semi-automatic in function.

A still further object of the present invention is to provide a muffler and tail pipe cleaner and expander which is low in cost and low in maintenance.

These together with other objects and advantages which will become subsequently apparent reside in th details of construction and operation as more fully hereinafter descried and claimed, reference being had to the accompanying drawings forming a part hereof, wherein like numrals refer to like parts throughout.

DESCRIPTION OF THE PREFERRED EMBODIMENT

Figure 1:
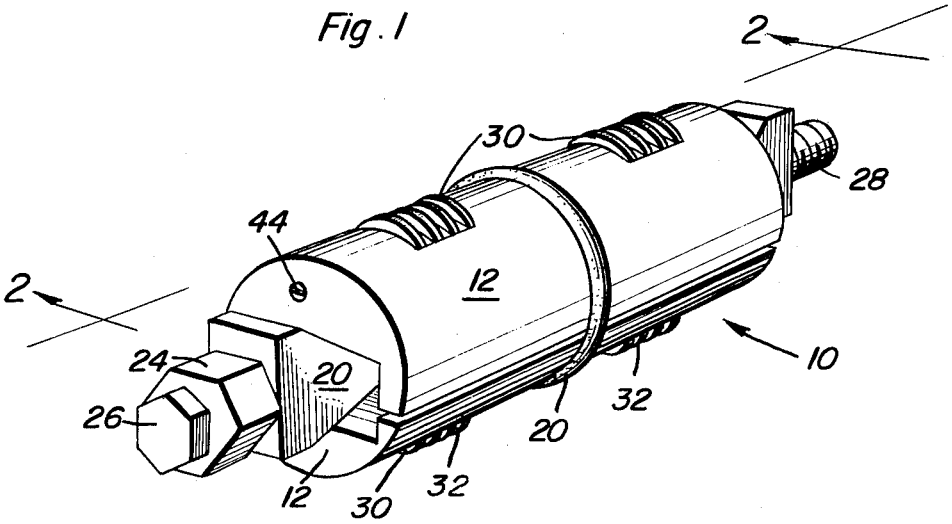
FIG. 1 is a perspective view of the device of this invention.

Referring now more particularly to the drawing, reference numeral 10 in FIG. 1 indicates the assembled tool ready for insertion into a tail pipe to be expanded and cleaned. The tool includes two frame segments 12, one of such segments being shown individually in FIG. 4. Midway between the ends on the outer circumference of each segment is provided a recess 18 for receiving a resilient O-ring 20, said ring being provided for the purpose of retaining the two segments with their flat surfaces together.

Between the recess 18 for the O-ring and the respective ends of each segment are provided two deep recesses 13 on the outer circumference of each of the segments. These recesses receive the serrated cleaning and metal-deforming rollers 30. The serrated rollers 30 include helically cut or formed threads 32 thereon. The threads being in a slight helix or angle relative to the rotational center of the rollers and function to semi-automatically effect operation of the tool. That is, once the tool has been inserted in the pipe or end of the muffler to be expanded and cleaned, the teeth of the serrated rollers will bite into the metal in order to cause a metal-working action as well as a cutting and cleaning action and the spiral nature of being worked upon.

Figure 2:
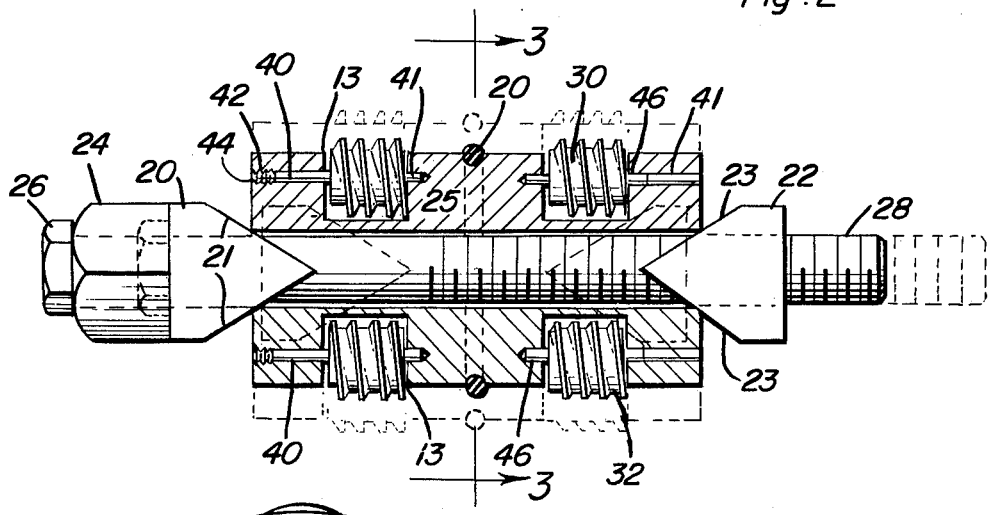
FIG. 2 is a cross-sectional view taken generally along line 2—2 of FIG. 1.
Figure 3:
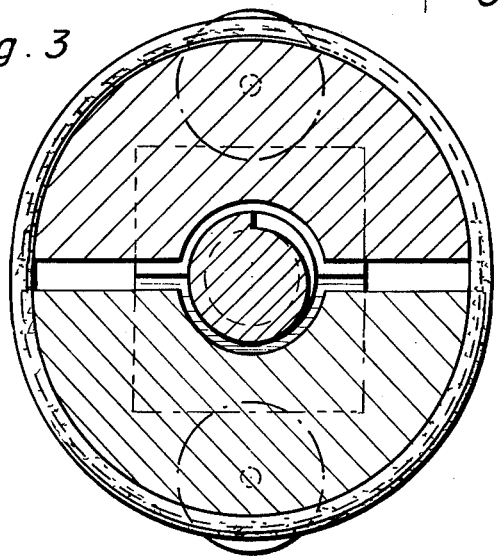
FIG. 3 is an enlarged cross-sectional view taken generally along line 3—3 of FIG. 2.

As best seen in FIG. 2, the rollers 30 within the recesses 13 were rotatably supported therein by means of pins 40 or 46 inserted in holes 41 appropriately drilled from the ends of the frame segments toward the center portion of said segments. The pin 40 shown as supporting both of the spiral serrated rollers 30 in the left portion of FIG. 2, is provided with a threaded end 42 for engagement with an appropriately threaded end of hole 41 in each of the frame segments. A screw-driver slot 44 is also provided at this end of the pin 40 so that the pin 40 may be positively retained in the hole 41 and yet easily and quickly removed by merely unscrewing the threaded portion 42 by means of conventional screw driver and removing the pin 40 entirely from the frame segment. This is a feature of the device which is important from the standpoint of quick, easy, replacement of worn and dull serrated rollers.

A slightly less expensive manner of building this tool is shown to the right in FIG. 2, wherein the hole 41 is merely drilled into the frame segments without any tappling of screw threads at the outer end thereof and a pin 46 which is sightly larger than hole 41 is press-fitted into the hole to support the roller. The disadvantage of this type of construction is that the pin 46 is almost impossible to remove and once the serrated rollers become worn and dull the tool loses much of its effectiveness. The replaceable pin 40 type construction is the preferred embodiment.

Figure 4:
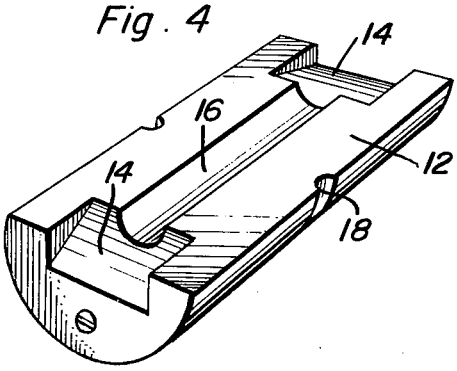
FIG. 4 is a perspective view of one of the split frame members of this invention.

Looking at FIG. 4, the flat side of the frame segment is provided with a center semi-circular recess 16 and with wedge-shaped recesses 14 at each of the ends of the segment. The angle of the wedge-shaped recesses 14 is such that when the two frame segments are assembled as in FIGS. 1 and 2 the camming members 20 and 22 with their cam surfaces 21 and 23, when drawn together will force the two frame segments apart. The wedging member 20 is different from the one 22 in that a wrench-engageable extension 24 is provided thereon The shape of this member 24 is such as to be readily engageable by a mechanic's socket-and-ratchet tools or by any conventional adjustable crescent wrench, open-end-wrench, or box wrench. The members 20, 22 and 24 have a central aperture for receiving a take-up and adjusting bolt 25 therethrough. The bolt 25 has a conventional wrench-engaging head 26 and a theaded end 28. The camming member 22 is appropriately threaded (not shown) for engagement with the threads 28 of the bolt 25.

Operation of the device is quite simple and easy. The over-all structure may be made in various sizes to fit wide ranges of pipes and mufflers to be worked upon. However, for the general automobile mechanic one or two of these devices will normally be sufficient for the general run of exhaust pipe sizes to be found in the field today. Assuming as an example a tail pipe having an internal diameter of approximately 2 inches which needs to be expanded and cleaned to receive an exhaust pipe of approximately 2 inches outside diameter, a tool of this invention would be inserted with the end having member 22 thereon into the pipe. The draw bolt 25 will then be turned by applying a wrench to the head 26 which action will being the camming elements 21 and 23 together. Acting against the cam surfaces 14 of the frame segment the frame segments will be expanded until the outer edges of the threaded portions 32 of the rollers are in engagement with the internal circumference of the pipe. At this point further tightening of the wedges 20 and 22 by means of bolt 25 is stopped and a wrench is applied to member 24 in order to rotate the entire tool within the pipe. As the tool is turned within the pipe the serrated rollers and their helical threads act to cut and cause metal working of the metal to both clean and expand the pipe. Because of the slight angle of the threads of the serrated rollers biting into the inner circumference of the pipe, the tool will be literally screwed into the pipe. Once the required length of pipe has been cleaned and expanded the user simply loosens the bolt 25 by rotating the head 26 in the opposite direction from that at the start, and then the entire tool may be easily withdrawn from the expanded pipe.

Several advantages are provided by this tool. Very little pressure is needed on the tool to complete the entire operation. The tool is semi-automatic in operation and very easy to apply and operate by the ordinary person. Speed of operation is another important advantage plus the resulting clean and well expanded pipe. This tool will completely remove all rust and exhaust contaminants from the inside of tail pipes and mufflers, and muffler extensions, plus it will properly size the internal circumferences of said pipes. This tool also will completely remove all visible dents.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Apparatus for expanding and cleaning pipes of varying internal diameter, comprising:

cylindrical body means formed of semi-cylindrical segments, the segments each having mounting recesses formed in the outer cylindrical walls thereof and further having expansion recesses formed in each end thereof, and extending longitudinally through the body means to respective communication with each other, resilient means for holding the two segments together;

a cylindrical roller mounted for rotation within each of the mounting recesses, each roller having threads formed on outer cylindrical surfaces thereof, the threads being turned at an angle to the longitudinal axis of the roller;

a wedge member located at each end of the body means and being at least partially received within the expansion recesses, each wedge member having an aperture formed therethrough, one of said apertures being threaded; and, an adjusting bolt received through the expansion recesses throughout the body means, the bolt being received through the apertures in each wedge member, at least one end of the bolt being threaded and being received within the threaded aperture in one of the wedge members, the bolt having a flanged head at the other end thereof, and a biasing member having an aperture formed therein, the bolt being received within the aperture, the biasing member lying between and being contiguous to the head of the bolt and the outer end of the other of the wedge members, the bolt being rotatable after insertion of the end of the assembly opposite the head of the bolt into an open end of a pipe to bias the wedge members toward each other, thereby displacing the segments of the body means towards the internal surfaces of the pipe to cause the threads on the rollers to engage said internal pipe surfaces, the biasing member then being rotatable in a plane parallel to the longitudinal axis of the body means and of that portion of the pipe in which at least a portion of the body means is disposed, thereby to cause the body means to rotate, the rollers also rotating and causing the angled threads thereon to cut into the internal pipe surfaces and to cause the body means to be displaced inwardly of the pipe.

2. The apparatus of claim 1 wherein the resilient means comprise a resilient O-ring surrounding the two segments, and wherein the segments each have a semi-circular recess, the recesses being aligned to receive the O-ring therewithin.

3. The apparatus of claim 2 wherein the recesses are formed centrally of the segments.

4. The apparatus of claim 1 wherein each segment of the body means has two rollers mounted thereon.

5. The apparatus of claim 1 wherein the angled threads on each roller are helical in conformation.

6. The apparatus of claim 1 and further comprising pin means mounted within each of the mounting recesses, the rollers being each mounted for rotation on the pin means.

7. The apparatus of claim 6 wherein the pin means comprises a mounting pin having a threaded end, and wherein one wall of each of the mounting recesses in each of the segments has a threaded aperture formed therein to receive the threaded end of the mounting pin disposed within the recess.

* * * * *